US005197812A

United States Patent [19]

Worley et al.

[11] Patent Number: 5,197,812

[45] Date of Patent: Mar. 30, 1993

[54] HIGH ACCURACY VACUUM BELT AND PINCH ROLLER MEDIA TRANSPORT MECHANISM

[75] Inventors: A. Justine Worley, Chino Hills; Harold R. Berrey, Moorpark, both of Calif.

[73] Assignee: Dataproducts Corporation, Woodland Hills, Calif.

[21] Appl. No.: 837,532

[22] Filed: Feb. 14, 1992

Related U.S. Application Data

[63] Continuation of Ser. No. 581,771, Sep. 13, 1990, abandoned, which is a continuation-in-part of Ser. No. 433,931, Nov. 9, 1989, abandoned.

[51] Int. Cl.[5] ..... B41J 13/08

[52] U.S. Cl. ..... 400/635; 400/645; 400/617; 271/197; 29/DIG. 78; 198/811

[58] Field of Search ..... 198/811; 400/578, 579, 400/617, 618, 635, 645, 627; 226/124, 195; 29/DIG. 78; 271/4, 194, 196, 197; 355/312; 101/389.1

[56] References Cited

U.S. PATENT DOCUMENTS 3,288,037 11/1966 Burnett ..... 271/197
4,237,466 12/1980 Scranton ..... 346/75
4,275,978 6/1981 Irwin ..... 414/156
4,302,103 11/1981 Zeunen ..... 355/84
4,326,656 4/1982 Gregory et al. ..... 226/195
4,463,361 7/1984 Koamura et al. ..... 355/73
4,792,249 12/1988 Lahr ..... 400/627

*Primary Examiner*—Edgar S. Burr
*Assistant Examiner*—Christopher A. Bennett
*Attorney, Agent, or Firm*—Spensley Horn Jubas & Lubitz

[57] ABSTRACT

A media transport mechanism including a high accuracy vacuum belt used in conjunction with a pinch roller assembly. The media transport mechanism includes a vacuum belt supportably wrapped around two sprocket assemblies and a plenum and disposed in facing relation to a print head. The vacuum belt has two pinch roller assemblies disposed in spaced-apart relation across the front surface of the vacuum belt, with each pinch roller assembly including two pinch rollers which, in conjunction with the vacuum belt, grip and advance a sheet of media across the front surface of the vacuum belt during printing. The plenum provides a vacuum hold-down force for holding the media flat against the front surface of the vacuum belt.

9 Claims, 4 Drawing Sheets

HIGH ACCURACY VACUUM BELT AND PINCH ROLLER MEDIA TRANSPORT MECHANISM

This is a continuation of application Ser. No. 07/581,771 filed on Sep. 13, 1990, now abandoned, which is a continuation-in-part of application Ser. No. 07/433,931, filed Nov. 9, 1989 now abandoned.

BACKGROUND

1. Field of the Invention

The present invention relates to a media transport mechanism in a printer and in particular to a high accuracy vacuum belt used in conjunction with pinch roller assemblies for precise media handling.

2. Description of the Prior Art

The prior art devices will be discussed in terms of printers, although the concepts may be equally applicable to other devices having vacuum belts in conjunction with pinch roller assemblies.

There has been a continuing need for precise media handling in a printer, and especially at the region of the media where the printing takes place. The prior art devices adopted one of many ways of transporting media through the printing area; however, each of them suffer from some inherent drawbacks which reduce the accuracy of the printing.

In one type of prior art device which uses a flat stationary platen, friction drive rollers alone are used. Typically, two sets of friction drive rollers are provided on two separate drive shafts. However, the use of friction drive rollers introduces printing inaccuracies due to some deficiencies. First, it is difficult to synchronize two drive shafts. A usual technique to overcome this problem is to slightly over-drive the exit rollers to ensure that the media is tensioned adequately. However, during the entrance and exit of the media, there are times when the media is held down by only one set of rollers. Inaccuracies may be introduced during the transition from one set of rollers to the other set. Second, inaccuracies may occur because the rollers may become deformed. Third, the leading and trailing edges of the media are not well controlled by the two sets of drive rollers.

In a second type of prior art device, a rotary platen is used to advance media through the printing area. However, since the printing surface is curved, the resulting print gap will vary, which will cause inconsistencies in printing.

In a third type of prior art device, a tractor feed device is used to transport continuous sheets of media across a printing area. However, the paper positioning accuracy is severely affected by the accuracy of the holes in the media. Furthermore, tractor feed is inappropriate for transporting individual cut sheets.

SUMMARY OF THE INVENTION

Accordingly, it is an object of this invention to provide a media transport mechanism which allows continuous and cut sheets of media to be transported through the printing area of a printer more precisely so as to reduce inaccuracies in printing.

It is another object of this invention to provide a media transport mechanism which accurately controls media linear velocity and displacement.

It is another object of this invention to provide a media transport mechanism which presents a flat printing surface adjacent the print head to maintain a constant print gap.

It is another object of this invention to provide a media transport mechanism which prevents the print head from contacting the media.

It is another object of this invention to provide a media transport mechanism which maintains control of the leading and trailing edges of the media at all times.

It is another object of this invention to provide a media transport mechanism which prevents media skew.

A media transport mechanism according to this invention comprises a vacuum belt supportably wrapped around two sprocket assemblies and plenum having a rigid platen with vacuum slots provided thereon. The vacuum belt is disposed in facing relation to a print head, the vacuum belt having two pinch roller assemblies disposed in spaced-apart relation across the front surface of the vacuum belt, with each pinch roller assembly including two pinch rollers which, in conjunction with the vacuum belt, grip and advance a sheet of media across the front surface of the vacuum belt during printing, with the plenum providing a vacuum hold-down force through the vacuum slots in the plenum for holding the media flat against the front surface of the vacuum belt.

BRIEF DESCRIPTION OF THE DRAWINGS

The invention will be described in connection with one embodiment thereof with reference to the accompanying drawings.

DESCRIPTION OF THE PREFERRED EMBODIMENT

A preferred embodiment of the vacuum belt and pinch roller assembly will be described with reference to FIGS. 1-5.

Figure 1:
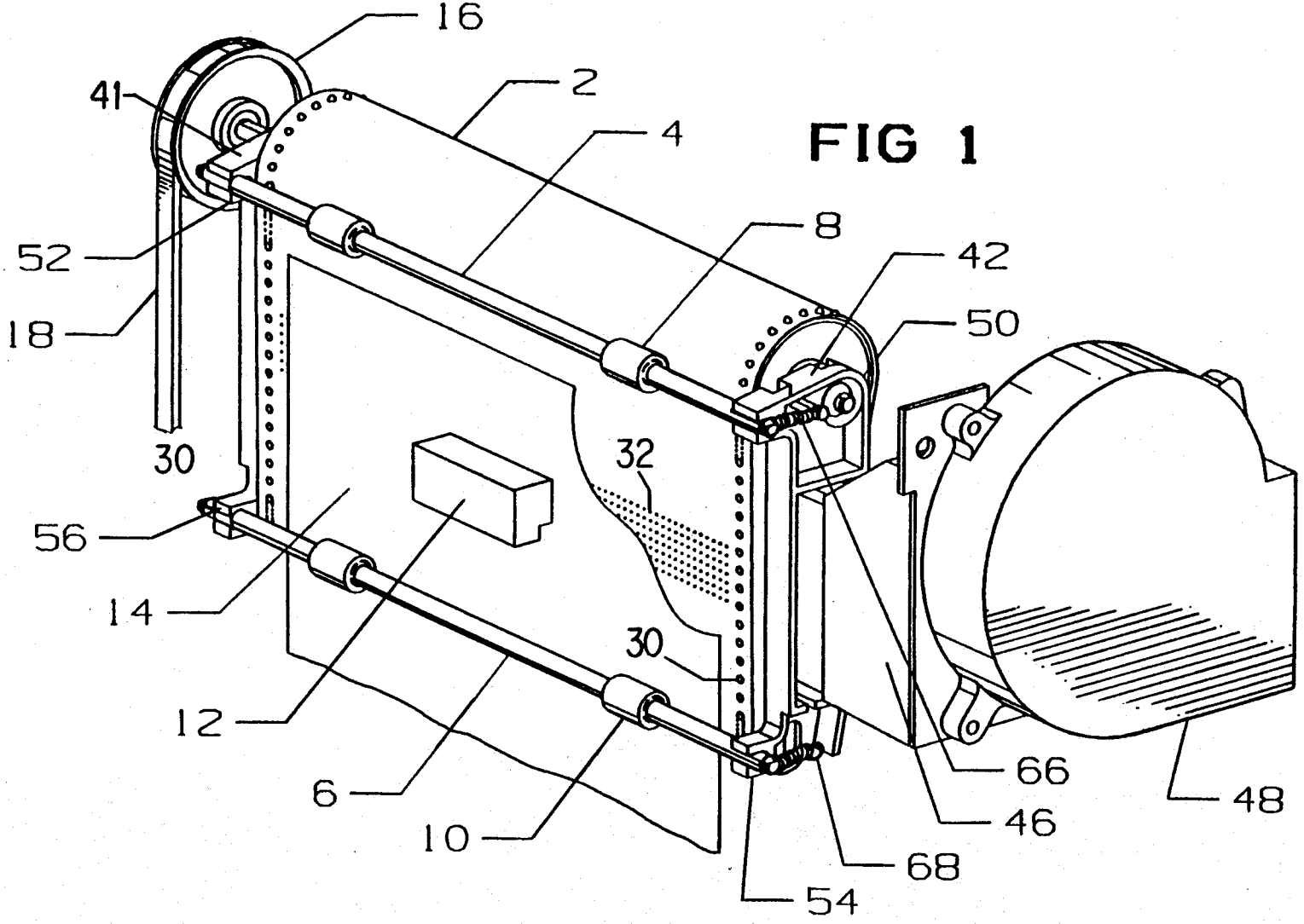
FIG. 1 is a perspective view of the vacuum belt and pinch roller assembly.
Figure 2:
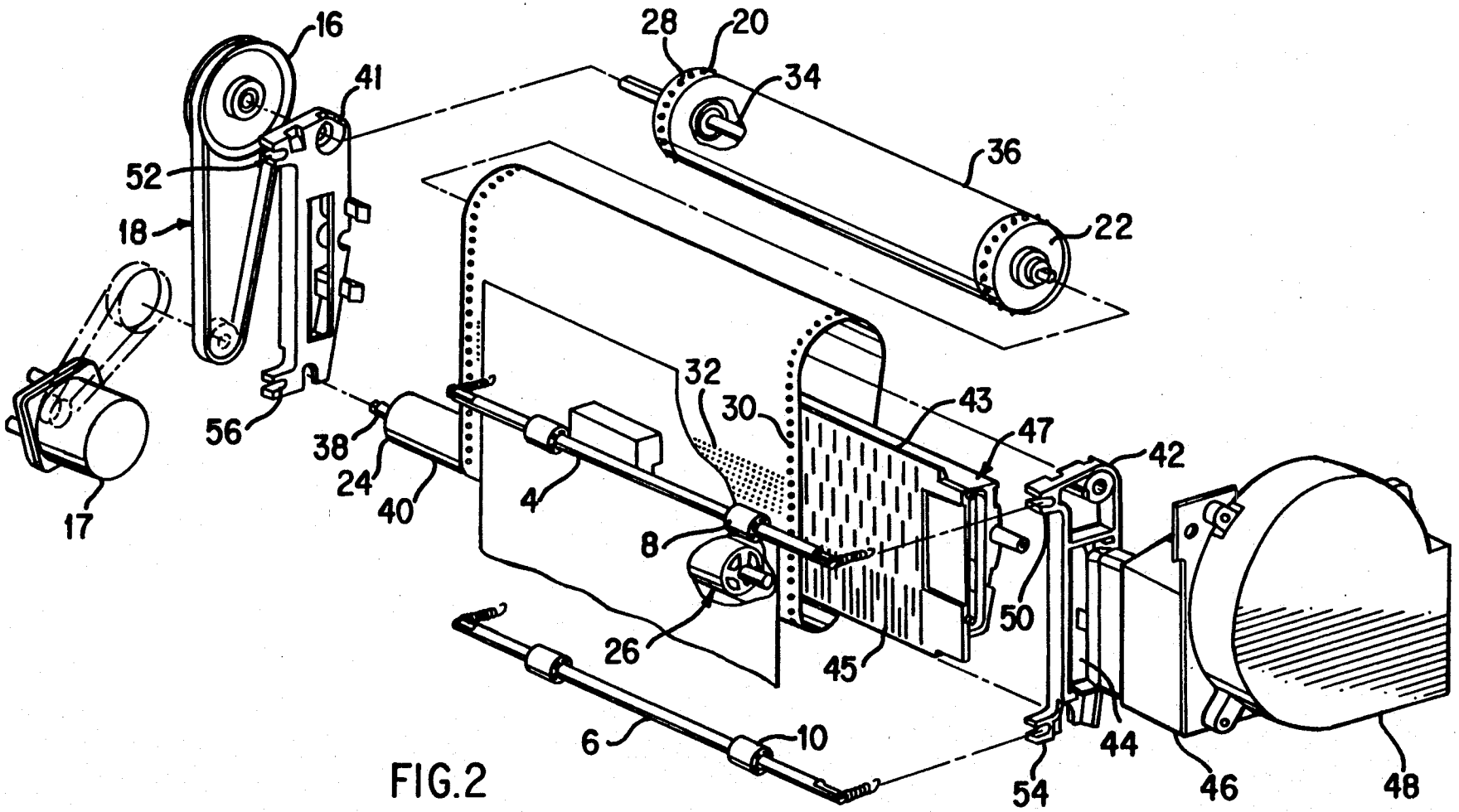
FIG. 2 is an exploded perspective view of the vacuum belt and pinch roller assembly.

FIGS. 1 and 2 show the vacuum belt and pinch roller assembly to be used in a printer, which may be, for example, an ink jet or impact printer. A vacuum belt 2 is wrapped around two sets of sprockets, a pair of upper sprockets comprising an upper left sprocket 20 and an upper right sprocket 22, and a pair of lower sprockets comprising a lower left sprocket 24 and a lower right sprocket 26.

The vacuum belt 2 is guided and driven by the upper sprockets. The upper left sprocket 20 and the upper right sprocket 22 are mounted on opposite ends of an upper idler shaft 34. The right end of the upper idler shaft 34 is fitted into a slot in a right end cap 42, while the left end of the upper idler shaft 34 extends through a left end cap 41 to mount the axle of a pulley 16, which operates to drive the upper idler shaft 34 and thus, the vacuum belt 2. Both the upper left sprocket 20 and the upper right sprocket 22 have sprocket pins 28 that ar adapted to be fitted into sprocket holes 30 on opposite edges of the vacuum belt 2 for driving the vacuum belt 2. The left end of a hollow elongated upper idler support roller 36 is attached to the inside of the upper left sprocket 20, and the right end of the hollow elongated upper idler support roller 36 is attached to the inside of the upper right sprocket 22. The upper idler support roller 36 encloses the upper idler shaft 34 and provides support to hold the vacuum belt 2 flat and to prevent the vacuum belt 2 from collapsing in the middle portion.

Unlike the upper sprockets, the lower left sprocket 24 and the lower right sprocket 26 do not have sprocket pins. Thus, the lower sprockets only guide but do not drive the vacuum belt 2. The lower left sprocket 24 and the lower right sprocket 26 are also mounted on opposite ends of a corresponding lower idler shaft 38. Unlike the upper idler shaft 34, the lower idler shaft 38 is not connected to a pulley and is not driven. The left end of the lower idler shaft shaft 38 is fitted into a slot in the left end cap 41, while the right end of the lower idler shaft shaft 38 is fitted into a slot in the right end cap 42. There is also a hollow lower idler support rollers 40 having its left end attached to the lower left sprocket 24 and its right end attached to the lower right sprocket 26. The lower idler support roller 40 encloses the lower idler shaft 38 and performs the same function as the upper idler support roller 36, that is, to provide support to hold the vacuum belt 2 flat and to prevent the vacuum belt 2 from collapsing in the middle portion.

Figure 4:
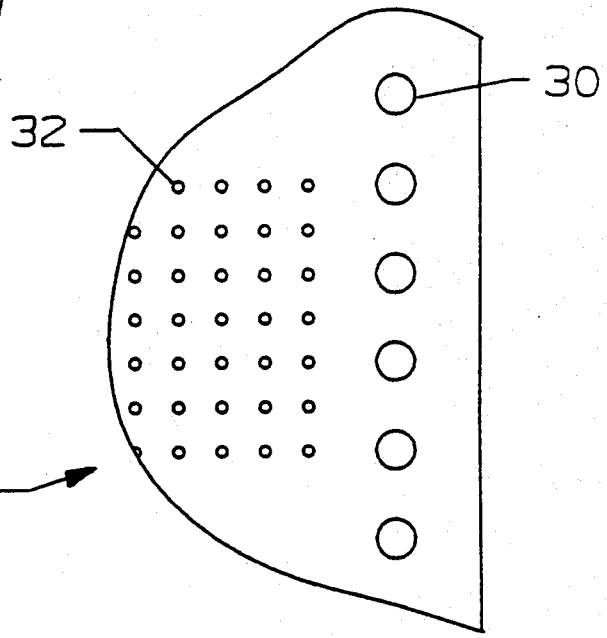
FIG. 4 is a view of a portion of the vacuum belt.

As shown in FIGS. 1, 2 and 4, the vacuum belt 2 is formed with a plurality of perforated vacuum holes 32 spaced one-eighth of an inch apart from each other. The vacuum holes 32 should be substantially small (e.g., 0.032 inches in diameter in the illustrated embodiment) to provide enough impedance to the air flow when a sheet of media 14 is not covering the holes 32. The sheet of media 14 may be any type of printable sheet medium, such as paper or transparency. The vacuum holes 32 should also be in close proximity to each other so that the whole surface of the vacuum belt 2 beneath the media 14 forms a vacuum. As shown in FIG. 1, the vacuum holes 32 extend over a width of the vacuum belt 2 which is greater than the width of the sheet of media 14. The vacuum belt 2 is also formed of a plurality of sprocket holes 30 which are aligned along both edges of the vacuum belt 2 and have a diameter which is wider than that of the vacuum holes 32. The sprocket holes aligned along the left edge of the vacuum belt 2 are adapted to receive the sprocket pins 28 of the upper left sprocket 20 while the sprocket holes aligned along the right edge of the vacuum belt 2 are adapted to receive the sprocket pins 28 of the upper right sprocket 22. The vacuum belt 2 is made from a flexible material, such as polyester, so that the inaccuracy due to belt-stretching is minimal.

Referring to FIGS. 1 and 2, the vacuum belt and pinch roller assembly further comprises two sets of pinch rollers, an upper set and a lower set. The upper set comprises a pair of upper pinch rollers 8 which are carried so as to engage the outside surface of the upper portion of the vacuum belt 2. The upper pinch rollers 8 are mounted on an upper roller shaft 4, which has its left end fitted into a slot in an upper left arm 52 and its right end fitted into a slot in an upper right arm 50. The upper roller shaft 4 is an idler shaft and is not driven at all. The upper right arm 50 is part of and extends from the frame of the right end cap 42 while the upper left arm 52 is part of and extends from the frame of the left end cap 41. Springs 66 are fitted along the external surface of the arms 50 and 52 to connect the opposite ends of the shaft 4 to the respective arms 50 and 52. The shaft 4 is spring-loaded by the springs 66 which bias the shaft 4 and the upper pinch rollers 8 against the vacuum belt. The rollers 8 rotate only in response to the motion of the vacuum belt 2 or the print media when present.

The lower set of pinch rollers is identical to the upper set. The lower set comprises a pair of lower pinch rollers 10 carried so as to engage the outside surface of the lower portion of the vacuum belt 2, and mounted on a lower roller shaft 6 supportably fitted at opposite ends in slots of a lower right arm 54 and a lower left arm 56. The lower right arm 54 and the lower left arm 56 extend from the frames of the right end cap 42 and the left end cap 41, respectively. Springs 68 are fitted along the external surface of the arms 54 and 56 to connect the opposite ends of the shaft 6 to the respective arms 54 and 56. The shaft 6 is spring-loaded by the springs 68 which bias the shaft 6 and the lower pinch rollers 10 against the vacuum belt.

Figure 5:
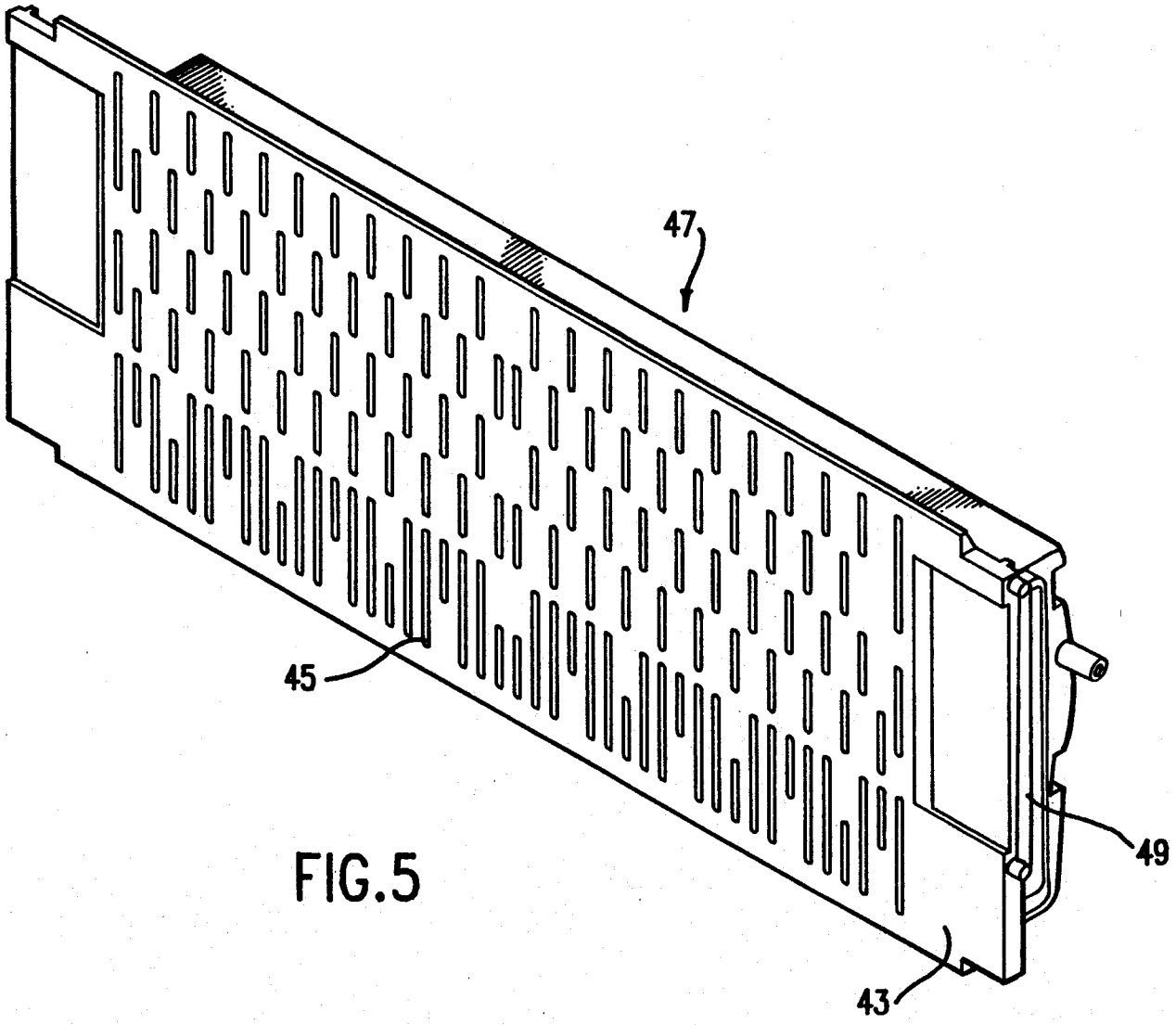
FIG. 5 is a perspective view of the plenum of FIG. 2.

A vacuum chamber or plenum 47 is provided as shown in FIGS. 2 and 5. The plenum 47 has a rigid platen 43 on its front face. The plenum 47 is essentially enclosed but has an opening 49 on its right side for receiving the generated vacuum pressure. As shown in FIGS. 1-3 and 5, the right end cap 42 has an opening 44 which receives the opening 49 on the right side of the plenum 47. The opening 44 in the right end cap 42 is connected to a vacuum blower 48 by a tube or duct 46. The vacuum blower 48 is capable of generating a vacuum at 0.2–0.4 inches of water at the flow rate of 10–100 cfm.

Referring to FIG. 2, the platen 43 is disposed on the inside surface of the vacuum belt 2 opposite from the print head 12, and provides support to the cross-sectional printing area of the vacuum belt 2 between the two sprocket assemblies. Further, as shown in FIGS. 2 and 5, the platen 43 is formed with a plurality of vacuum slots 45 so that the generated vacuum can be effectively felt by the print media 14 through the plurality of vacuum holes 32 while the vacuum belt 2 and the print media 14 are being collectively advanced. The rear surface and the left side of the plenum 47 are also enclosed so that the plenum 47 is air-tight. This prevents the vacuum force from escaping except through the vacuum slots 45.

The pulley 16 is belt-driven by a belt 18. A stepper motor 17 drives the pulley 16 so as to rotate the upper idler shaft 34, the upper left sprocket 20 and the upper right sprocket 22 in the clockwise direction (see FIGS. 2 and 3). The rotation of the upper sprockets cause the sprocket pins 28 fitted in the sprocket holes 30 on the vacuum belt 2 to rotatably advance the vacuum belt 2.

The operation of the vacuum belt and pinch roller assembly will now be described with reference to FIGS. 1 and 3. A sheet of media 14 is initially picked from a media source, such as a tray or cassette, and the media's leading edge delivered to the lower portion of the front surface of the vacuum belt 2. The leading edge of the media 14 is gripped by the lower pinch rollers 10 and the vacuum belt 2. As the vacuum belt 2 advances, the lower pinch rollers 10 also rotate and help to advance the media 14 along the front surface of the vacuum belt 2. A vacuum hold-down force is provided by the vacuum slots 45 in the plenum 47 located on the inside of the vacuum belt 2 to ensure that the media 14 is held flat against the front surface of the vacuum belt as the media is advanced through a printing area. The printing area is defined as the area of the vacuum belt 2 between the upper pinch rollers 8 and the lower pinch rollers 10. The arrows 58 in FIG. 3 indicate the direction in which the media 14 is pulled towards the vacuum belt 2 by the vacuum hold-down force.

Figure 3:
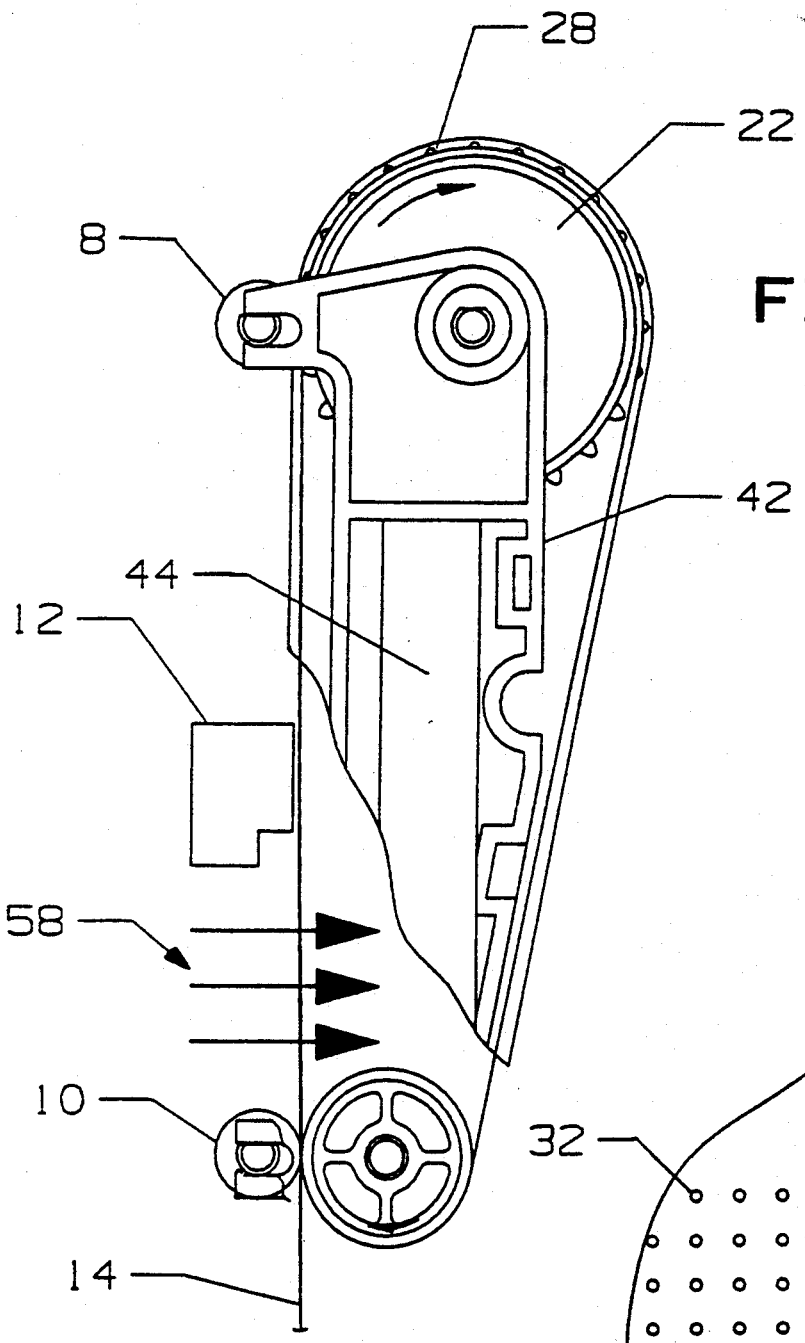
FIG. 3 is a right side view of the right side of the vacuum belt and pinch roller assembly, with a portion broken away.

As the media 14 is advanced through the printing area, a reciprocating print head 12 held out of contact with the media 14 prints the desired pattern or text onto the media 14 (see FIGS. 1 and 3). As the media 14 is advanced across the front surface of the vacuum belt 2, the upper pinch rollers 8 engage the leading edge of the media 14 and operate in unison with the vacuum belt 2 and the lower pinch rollers 10. As the trailing edge of the media 14 disengages the lower pinch rollers 10, the upper pinch rollers 8 assume control of the media 14 together with the vacuum belt 2 until the trailing edge of the media 14 is disengaged from the upper pinch rollers 8 and delivered to an output tray (not shown).

The vacuum belt and pinch roller assembly described above accurately controls the transportation of continuous and cut sheets of media 14 through the printing area and ensures accurate linear velocity and displacement of the media. The use of the pinch rollers in conjunction with the vacuum belt allows control of the leading and trailing edges of the media 14 at all times while the media 14 is within the printing area. The vacuum belt and pinch roller assembly also prevents the print head 12 from touching the media 14, and the effective vacuum hold-down force and the flat surface of the vacuum belt ensure that the gap between the media 14 and the print head 12 is contant so as to improve print quality.

While the invention has been shown and described with reference to a preferred embodiment thereof, it will be appreciated by those having skill in the art that variations in form and detail may be made therein without departing from the spirit and scope of the invention.

What is claimed is:

1. A printer having a print head for printing a pattern onto a sheet of media having a direction of travel through said printer and a width dimension transverse to said direction of travel, said printer comprising:

(a) a vacuum belt having a front face;

(b) means for advancing the vacuum belt along said direction of travel;

(c) two pinch roller assemblies disposed in spaced-apart relation along said direction of travel and across said front surface of the vacuum belt, each pinch roller assembly including a plurality of pinch rollers, said pinch roller assemblies defining between them a printing area along the front surface of the vacuum belt within which area said print head is adapted to print onto said sheet of media;

(d) means for biasing the plurality of pinch rollers against the vacuum belt; and (e) means for providing a vacuum hold-down force for holding the sheet of media flat against the front surface of the vacuum belt; wherein the sheet of media is gripped by the vacuum belt along substantially the entire width dimension of the sheet of media and by the pinch rollers of at least one pinch roller assembly.

2. A printer as recited in claim 1, wherein the means for providing a vacuum hold-down force includes a plenum disposed on an inner surface of the vacuum belt.

3. A printer as recited in claim 1, wherein the means for advancing the vacuum belt includes two sprocket assemblies, each sprocket assembly including a drive shaft, a plurality of support rollers and two sprockets, the drive shaft and the plurality of support rollers extending between the two sprockets.

4. A printer as recited in claim 3, wherein the means for advancing the vacuum belt further includes a stepper motor.

5. A printer as recited in claim 3, wherein the vacuum belt is supportably wrapped around the two sprocket assemblies and disposed in facing relation to the print head.

6. A printer for printing on sheet media having a direction of travel through said printer and a width dimension transverse to said direction of travel, said printer comprising:

(a) a print head;

(b) two sprocket assemblies, each sprocket assembly including a plurality of support rollers, a drive shaft, and two sprockets, the drive shaft and the plurality of support rollers extending between the two sprockets;

(c) a vacuum belt supportably wrapped around the support rollers of the two sprocket assemblies and having a front surface, said print head facing said front surface;

(d) two pinch roller assemblies disposed in spaced-apart relation along said direction of travel across said front surface of the vacuum belt, each pinch roller assembly including a plurality of pinch rollers mounted on an idle roller shaft;

(e) means for biasing the plurality of pinch rollers against the vacuum belt;

(f) a printing area located on an area of the front surface of the vacuum belt between the two pinch roller assemblies, said print head facing said printing area;

(g) a plenum disposed on an inner surface of the vacuum belt opposite the printing area, the plenum including a front plate having a plurality of vacuum slots;

(h) means for providing a vacuum hold-down force through the plenum and the vacuum belt for holding said sheet media flat against the front surface of the vacuum belt; and (i) means for driving at least one of the sprocket assemblies to advance the vacuum belt and sheet media in the direction of travel through the printing area, wherein the sheet media is gripped by the vacuum belt along substantially the entire width dimension of said sheet media and by the pinch rollers of at least one pinch roller assembly.

7. A printer as recited in claim 6, wherein the means for providing the vacuum hold-down force includes a vacuum blower.

8. A printer as recited in claim 6, wherein the two sprocket assemblies include an upper sprocket assembly and a lower sprocket assembly, with each sprocket of the upper sprocket assembly comprising a plurality of sprocket pins, and wherein the vacuum belt comprises vacuum holes and sprocket holes, the sprocket holes being adapted to fit the sprocket pins.

9. A printer as recited in claim 6, wherein the driving means includes a stepper motor.

* * * * *